US009156137B2

(12) United States Patent
Levashov et al.

(10) Patent No.: US 9,156,137 B2
(45) Date of Patent: Oct. 13, 2015

(54) COPPER BASED BINDER FOR THE FABRICATION OF DIAMOND TOOLS

(75) Inventors: Evgeny Aleksandrovich Levashov, Moscow (RU); Vladimir Alekseevich Andreev, Moscow (RU); Viktoriya Vladimirovna Kurbatkina, Moscow (RU); Alexandr Anatol'evich Zaitsev, Moscow (RU); Dar'ya Andreevna Sidorenko, Moskovskaya obl. (RU); Sergei Ivanovich Rupasov, Moscow (RU)

(73) Assignees: Federal State Budgetary Institution <Federal Agency for Legal Protection of Military, Special and Dual Use Intellectual Activity Results>, Moscow (RU); National University of Science and Technology "MISIS", Moscow (RU)

( * ) Notice: Subject to any disclaimer, the term of this patent is extended or adjusted under 35 U.S.C. 154(b) by 236 days.

(21) Appl. No.: 13/582,194

(22) PCT Filed: Feb. 17, 2011

(86) PCT No.: PCT/RU2011/000087

§ 371 (c)(1), (2), (4) Date: Aug. 31, 2012

(87) PCT Pub. No.: WO2011/108959

PCT Pub. Date: Sep. 9, 2011

(65) Prior Publication Data

US 2012/0325049 A1 Dec. 27, 2012

(30) Foreign Application Priority Data

Mar. 1, 2010 (RU) ..... 2010107314
Mar. 1, 2010 (RU) ..... 2010107315

(51) Int. Cl.
*B22F 1/00* (2006.01)
*B24D 99/00* (2010.01)
*B24D 3/06* (2006.01)

(52) U.S. Cl.
CPC ..... *B24D 99/005* (2013.01); *B24D 3/06* (2013.01)

(58) Field of Classification Search
CPC ..... B22F 1/00; B24D 99/005
USPC ..... 75/252
See application file for complete search history.

(56) References Cited

U.S. PATENT DOCUMENTS

| | | | | |
|---|---|---|---|---|
| 4,362,535 | A | 12/1982 | Isobe et al. | |
| 6,312,497 | B1 * | 11/2001 | Standaert | 419/11 |
| 2012/0085585 | A1 * | 4/2012 | Scott et al. | 175/428 |

FOREIGN PATENT DOCUMENTS

| | | | |
|---|---|---|---|
| RU | 2172238 | C2 * | 8/2001 |
| RU | 2286241 | C1 | 10/2006 |
| RU | 2286242 | C1 | 10/2006 |

OTHER PUBLICATIONS

Zaitsev et al, "Features of the Influence of Nanodispersed Additions on the Process of and Properties of the Fe—C0—Cu—Sn Sintered Alloy", Russian Journal of Non-Ferrous Metals, 2008, vol. 49, No. 5, pp. 414-419.*

* cited by examiner

*Primary Examiner* — Jessee Roe
*Assistant Examiner* — Christopher Kessler
(74) *Attorney, Agent, or Firm* — Nath, Goldberg & Meyer; Jerald L. Meyer

(57) ABSTRACT

This invention relates to powder metallurgy, more specifically, to composite material production methods, and can be used for the production of copper base binders for diamond tools used in the construction industry and stone working. The copper binder comprises the following components (wt. %): Copper (30-60), iron (20-35), cobalt (10-15), tin (0-10.5), tungsten carbide (0-20) and an alloying addition. According to the first variant the alloying addition is a nanopowder having a specific surface area 6-25 $m^2/g$, which is present in an amount of 1-15% wt. According to the second variant the alloying addition is a nanopowder having a specific surface area of 75-150 $m^2/g$, which is present in an amount of 0.01-5% wt. The binder possesses a high wear resistance without the essential increase in the required sintering temperature, as well as high hardness, strength and impact toughness.

4 Claims, No Drawings

COPPER BASED BINDER FOR THE FABRICATION OF DIAMOND TOOLS

This is a National Phase Application filed under 35 U.S.C. 371 as a national stage of PCT/RU2011/000087, filed Feb. 17, 2011, and claiming the benefit from Russian Application No. 2010107315, filed Mar. 1, 2010 and from Russian Application No. 2010107314, filed Mar. 1, 2010, the content of each of which is hereby incorporated by reference in its entirety.

FIELD OF THE INVENTION

This invention relates to powder metallurgy, more specifically, to composite material production methods, and can be used for the production of copper base binders for diamond tools sued in the construction industry and stone working, including different designs of segment cutting-off abrasive wheels used for highway and runway repairs, refurbishment of metallurgical plants and nuclear power plants, renovation of bridges and other structures, as well as drills and segment cutting-off abrasive wheels for cutting of high-strength reinforced concretes.

Binder affects the design of a tool. It is the binder that determines the choice of the casing material and the method of bounding the diamond layer with the case. Physical and mechanical properties of binders determine potential shapes and sizes of abrasive diamond tools.

BACKGROUND OF THE INVENTION

Known is a diamond tool binder (RU 2286241 C2, publ. Jul. 7, 2006) comprising a metal selected from the group of iron of the Periodic Table of the Elements, titanium carbide and a metal/metalloid compound. Said binder further comprises zirconium carbide to increase binder strength and diamond grain binding.

Disadvantages of said known binder are the use of expensive and noxious cobalt, a reduced cutting speed for highly reinforced concrete and a shorter tool life.

The prototype of the invention disclosed herein is a diamond tool binder (RU 2172238 C2, publ. 2001.08.20, cl. B24D 3/06) comprising a copper base and tin, nickel, aluminum and ultrafine-grained diamond additives.

Disadvantages of said material are insufficient wear resistance, hardness, strength and impact toughness.

The object of this invention is to provide diamond tool binders having a higher wear resistance without an essential increase in the required sintering temperature, as well as higher hardness, strength and impact toughness.

DISCLOSURE OF THE INVENTION

Given below are examples pf several types of diamond tool binders according to the invention disclosed herein wherein the above object is achieved by adding a copper group metal as the main binder component and an alloying addition in the form of nanopowder.

The copper base diamond tool binder has the following components in the following ratios, wt. %:

Cu=30-60

Fe=20-35

Co=10-15

Sn=0-10.5

WC=0-20 alloying addition=1-15.

The alloying addition is introduced in the form of 6-25 $m^2/g$ specific surface area nanopowder.

In specific embodiments, the alloying addition can be tungsten carbide or tungsten or molybdenum or aluminum oxide or zirconium dioxide or niobium carbide and/or silicon nitride.

In another embodiment of this invention, the copper base diamond tool binder has the following components in the following ratios, wt. %:

Cu=30-60

Fe=20-35

Co=10-15

Sn=0-10.5

WC=0-20 alloying addition=0.01-5.

The alloying addition is introduced in the form of 75-150 $m^2/g$ specific surface area nanopowder.

In specific embodiments, the alloying addition comprises carbon nanotubes or nanosize grained diamond.

In either embodiment of this invention, the presence of copper, iron, cobalt and strengthening nanoparticles in the binder allows the binder to meet the following requirements:

a) good wettability for diamond;

b) strong binding of diamond grains;

c) self-sharpening, i.e. the binder is worn out as diamond grains are blunting so the blunt grains are chipped out to uncover the cutting faces of new grains;

d) sufficient heat stability and high heat conductivity;

e) minimum friction ratio to the material being processed;

f) linear expansion coefficient close to that of diamond;

g) no chemical reaction with the material being processed and the coolant.

Alloying additives of the composition disclosed above provide for high hardness, high-temperature strength and heat stability of the binders which in turn increase the cutting speed and tool life.

For the first embodiment of this invention, alloying additives in quantities below the bottom limit of the range provided herein (1 wt. %) are insufficient for efficient dispersion hardening of the binder, and their effect on the structure and properties of the resultant material is but little. However, if the quantity of the alloying additives is above the top limit of the range provided herein (15 wt. %), the content of the nanosize component is too high. As the alloying additives are more refractory and hard and have higher elasticity moduli compare to copper, they concentrate internal stresses thus causing a pronounced brittle behavior of the material, reducing the strength and wear resistance of the binder, increasing the required sintering temperature and compromising the compressibility. The above alloying additive concentration range (1-15 wt. %) is only true for 6-25 $m^2/g$ specific surface area nanosized powders because theoretical and experimental data suggest that the efficiency of dispersion hardening depends not only on the content of nanoparticles in the alloy but also on their average size which in turn can be calculated from the specific surface area of the nanopowder.

For the second embodiment of this invention, alloying additives in quantities below the bottom limit of the range provided herein (0.01 wt. %) are insufficient for efficient dispersion hardening of the binder, and their effect on the structure and properties of the resultant material is but little. However, if the quantity of the alloying additives is above the top limit of the range provided herein (5 wt. %), the content of the nanosize component is too high. As the alloying additives are more refractory and hard and have higher elasticity moduli compare to copper, they concentrate internal stresses thus causing a pronounced brittle behavior of the material, reducing the strength and wear resistance of the binder, increasing the required sintering temperature and compromising the compressibility.

The above alloying additive concentration range (0.01-5 wt. %) is only true for 75-150 $m^2/g$ specific surface area nanosized powders because theoretical and experimental data suggest that the efficiency of dispersion hardening depends not only on the content of nanoparticles in the alloy but also on their average size which in turn can be calculated from the specific surface area of the nanopowder.

EMBODIMENTS OF THE INVENTION

Binders can be produced using the method of powder metallurgy: sintering followed by compression at the sintering temperature. This method has a high output because the total duration of heating to the sintering temperature, exposure to the sintering temperature, compression and cooling to room temperature is within 15 minutes. High heating rates and a homogeneous temperature distribution in the working chamber are provided by electric current passing through the sintering mould serving also as a die.

Exposure to the sintering temperature is immediately followed by compression which produces the required density and shape of the product. The die design allows the process to be conducted in an inert or protective atmosphere to increase the quality of the tool.

Tables 1-3 show examples illustrating how the properties of the binder according to the first embodiment of the invention depend on binder composition and the content of the alloying addition.

TABLE 1

Binder Properties vs Nanosize Grained Tungsten Carbide WC Concentration

| Composition, wt. % | Properties** | | | | | |
|---|---|---|---|---|---|---|
| | Porosity, % | Rockwell Hardness | Bending Strength $\sigma^{изг}$, MPa | Specific Wear, $mm/m^2$ | Specific cutting wheel life, $m^2/mm$ | Cutting Speed, $cm^2/min$ |
| 100% $Cu_{binder}$* | 1 | 92 | 690 | 2.80 | 0.36 | 220 |
| 99.1% $Cu_{binder}$ + 0.9% WC | 1.1 | 91 | 680 | 2.90 | 0.30 | 210 |
| 99% $Cu_{binder}$ + 1% WC | 1.5 | 97 | 720 | 2.55 | 0.39 | 255 |
| 96% $Cu_{binder}$ + 4% WC | 1.5 | 107 | 790 | 1.80 | 0.55 | 350 |
| 90% $Cu_{binder}$ + 10% WC | 1.6 | 102 | 765 | 2.20 | 0.45 | 280 |
| 85% $Cu_{binder}$ + 15% WC | 1.8 | 95 | 700 | 2.65 | 0.38 | 240 |
| 84% $Cu_{binder}$ + 16% WC | 3 | 87 | 640 | 3.50 | 0.15 | 150 |

*$Cu_{binder}$ composition: 30% Cu; 35% Fe; 15% Co; 10.5% Sn; 9.5% WC

**specific wear, specific life and cutting speed are given for cutting wheel tests with highly reinforced M400 concrete.

TABLE 2

Binder Properties vs Nanosize Grained Zirconium Oxide Concentration

| Composition, wt. % | Properties** | | | | | |
|---|---|---|---|---|---|---|
| | Porosity, % | Rockwell Hardness | Bending Strength $\sigma^{изг}$, MPa | Specific Wear, $mm/m^2$ | Specific cutting wheel life, $m^2/mm$ | Cutting Speed, $cm^2/min$ |
| 100% $Cu_{binder}$* | 1 | 93 | 720 | 2.50 | 0.4 | 230 |
| 99.1% $Cu_{binder}$ + 0.9% $ZrO_2$ | 1.1 | 90 | 680 | 2.80 | 0.36 | 220 |
| 99% $Cu_{binder}$ + 1% $ZrO_2$ | 1.2 | 101 | 745 | 2.35 | 0.43 | 260 |
| 96% $Cu_{binder}$ + 4% $ZrO_2$ | 1.4 | 110 | 850 | 1.80 | 0.56 | 370 |
| 90% $Cu_{binder}$ + 10% $ZrO_2$ | 1.6 | 100 | 810 | 2.10 | 0.48 | 310 |
| 85% $Cu_{binder}$ + 15% $ZrO_2$ | 1.7 | 98 | 780 | 2.55 | 0.39 | 270 |
| 84% $Cu_{binder}$ + 16% $ZrO_2$ | 3.0 | 86 | 650 | 3.20 | 0.31 | 180 |

*$Cu_{binder}$ composition: 40% Cu; 25% Fe; 10% Co; 5% Sn; 20% WC

**specific wear, specific life and cutting speed are given for cutting wheel tests with highly reinforced M400 concrete.

TABLE 3

Binder Properties vs Nanosize Grained Aluminum Oxide Concentration

| Composition, wt. % | Properties** | | | | | |
|---|---|---|---|---|---|---|
| | Porosity, % | Rockwell Hardness | Bending Strength $\sigma^{изг}$, MPa | Specific Wear, $mm/m^2$ | Specific cutting wheel life, $m^2/mm$ | Cutting Speed, $cm^2/min$ |
| 100% $Cu_{binder}$* | 1.0 | 90 | 650 | 3.0 | 0.33 | 220 |
| 99.1% $Cu_{binder}$ + 0.9% $Al_2O_3$ | 1.1 | 88 | 620 | 3.5 | 0.29 | 210 |
| 99% $Cu_{binder}$ + 1% $Al_2O_3$ | 1.2 | 95 | 690 | 2.9 | 0.34 | 230 |
| 96% $Cu_{binder}$ + 4% $Al_2O_3$ | 1.4 | 100 | 720 | 2.0 | 0.50 | 310 |
| 90% $Cu_{binder}$ + 10% $Al_2O_3$ | 1.7 | 98 | 710 | 2.4 | 0.42 | 265 |
| 85% $Cu_{binder}$ + 15% $Al_2O_3$ | 1.8 | 94 | 670 | 2.8 | 0.36 | 225 |
| 84% $Cu_{binder}$ + 16% $Al_2O_3$ | 3.0 | 85 | 610 | 3.7 | 0.27 | 150 |

*$Cu_{binder}$ composition: 60% Cu; 20% Fe; 10% Co; 0% Sn; 10% WC

**specific wear, specific life and cutting speed are given for cutting wheel tests with highly reinforced M400 concrete.

Tables 4-6 show examples illustrating how the properties of the binder according to the second embodiment of the invention depend on binder composition and the content of the alloying addition.

TABLE 4

Binder Properties vs Carbon Nanotube Concentration

| Composition, wt. % | Properties** | | | | | |
|---|---|---|---|---|---|---|
| | Porosity, % | Rockwell Hardness | Bending Strength $\sigma^{изг}$, MPa | Specific Wear, $mm/m^2$ | Specific cutting wheel life, $m^2/mm$ | Cutting Speed, $cm^2/min$ |
| 100% $Cu_{связка}$* | 1 | 92 | 690 | 2.8 | 0.36 | 220 |
| 99.994% $Cu_{binder}$ + 0.006% $C_{nt}$ | 1.1 | 90 | 690 | 2.9 | 0.34 | 210 |
| 99.99% $Cu_{binder}$ + 0.01% $C_{nt}$ | 1.1 | 94 | 730 | 2.50 | 0.40 | 315 |
| 99.95% $Cu_{binder}$ + 0.05% $C_{nt}$ | 1.2 | 98 | 750 | 2.25 | 0.44 | 325 |
| 99% $Cu_{binder}$ + 1% $C_{nt}$ | 1.2 | 103 | 780 | 1.90 | 0.53 | 340 |
| 95% $Cu_{binder}$ + 5% $C_{nt}$ | 1.6 | 95 | 730 | 2.40 | 0.42 | 310 |
| 94% $Cu_{binder}$ + 6% $C_{nt}$ | 3.1 | 89 | 620 | 3.7 | 0.27 | 160 |

*$Cu_{binder}$ composition: 30% Cu; 35% Fe; 15% Co; 10.5% Sn; 9.5% WC

**specific wear, specific life and cutting speed are given for cutting wheel tests with highly reinforced M400 concrete.

TABLE 5

Binder Properties vs Carbon Nanotube Concentration

| Composition, wt. % | Properties** | | | | | |
|---|---|---|---|---|---|---|
| | Porosity, % | Rockwell Hardness | Bending Strength $\sigma^{изг}$, MPa | Specific Wear, $mm/m^2$ | Specific cutting wheel life, $m^2/mm$ | Cutting Speed, $cm^2/min$ |
| 100% $Cu_{связка}$* | 1 | 93 | 720 | 2.50 | 0.40 | 230 |
| 99.994% $Cu_{binder}$ + 0.006% $C_{nt}$ | 1.1 | 92 | 710 | 2.60 | 0.38 | 220 |
| 99.99% $Cu_{binder}$ + 0.01% $C_{nt}$ | 1.1 | 97 | 760 | 2.35 | 0.43 | 325 |
| 99.95% $Cu_{binder}$ + 0.05% $C_{nt}$ | 1.2 | 100 | 790 | 2.10 | 0.48 | 350 |
| 99% $Cu_{binder}$ + 1% $C_{nt}$ | 1.2 | 108 | 820 | 1.75 | 0.57 | 365 |
| 95% $Cu_{binder}$ + 5% $C_{nt}$ | 1.4 | 98 | 740 | 2.25 | 0.44 | 315 |
| 94% $Cu_{binder}$ + 6% $C_{nt}$ | 3.0 | 90 | 640 | 3.40 | 0.29 | 175 |

*$Cu_{binder}$ composition: 40% Cu; 25% Fe; 10% Co; 5% Sn; 20% WC

**specific wear, specific life and cutting speed are given for cutting wheel tests with highly reinforced M400 concrete.

TABLE 6

Binder Properties vs Nanosize Grained Diamond Concentration

| Composition, wt. % | Properties ** | | | | | |
|---|---|---|---|---|---|---|
| | Porosity, % | Rockwell Hardness | Bending Strength $\sigma^{изг}$, MPa | Specific Wear mm/m$^2$ | Specific cutting wheel life, m$^2$/mm | Cutting Speed, cm$^2$/min |
| 100% $\mathbf{Cu_{связка}}$* | 1 | 93 | 720 | 2.50 | 0.40 | 230 |
| 99.994% $Cu_{binder}$ + 0.006% $C_{diamt}$ | 1.1 | 92 | 710 | 2.60 | 0.38 | 220 |
| 99.99% $Cu_{binder}$ + 0.01% $C_{diam}$ | 1.1 | 97 | 760 | 2.35 | 0.43 | 325 |
| 99.95% $Cu_{binder}$ + 0.05% $C_{diam}$ | 1.2 | 100 | 790 | 2.10 | 0.48 | 350 |
| 99% $Cu_{binder}$ + 1% $C_{diam}$ | 1.2 | 108 | 820 | 1.75 | 0.57 | 365 |
| 95% $Cu_{binder}$ + 5% $C_{diam}$ | 1.4 | 98 | 740 | 2.25 | 0.44 | 315 |
| 94% $Cu_{binder}$ + 6% $C_{diam}$ | 3.0 | 90 | 640 | 3.40 | 0.29 | 175 |

*$Cu_{binder}$ composition: 60% Cu; 20% Fe; 10% Co; 0% Sn; 10% WC

**specific wear, specific life and cutting speed are given for cutting wheel tests with highly reinforced M400 concrete.

Along with the binder composition, the grain size of the alloying additive which can be represented as the specific surface area of the powder has a strong effect on the binder properties. Tables 7-8 show examples illustrating how the properties of the binder depend on the alloying powder specific surface area.

TABLE 7

Binder Properties for the First Embodiment of the Invention vs Nanosize Grained Tungsten Carbide WC Powder Specific Surface Area

| WC Specific Surface Area, m$^2$/g | Properties** | | | | | |
|---|---|---|---|---|---|---|
| | Porosity, % | Rockwell Hardness | Bending Strength $\sigma^{изг}$, MPa | Specific Wear, mm/m$^2$ | Specific cutting wheel life, m$^2$/mm | Cutting Speed, cm$^2$/min |
| 100% $Cu_{binder}$* | 1 | 92 | 690 | 2.8 | 0.36 | 220 |
| 5 | 1.2 | 91 | 650 | 3.2 | 0.30 | 200 |
| 6 | 1.5 | 102 | 730 | 2.65 | 0.43 | 250 |
| 10 | 1.8 | 109 | 790 | 1.80 | 0.55 | 350 |
| 20 | 2.0 | 104 | 750 | 2.10 | 0.48 | 320 |
| 25 | 2.1 | 94 | 710 | 2.50 | 0.40 | 225 |
| 27 | 4.5 | 80 | 390 | 4.60 | 0.18 | 170 |

*$Cu_{binder}$ composition: 30% Cu; 35% Fe; 15% Co; 10.5% Sn; 9.5% WC

**specific wear, specific life and cutting speed are given for cutting wheel tests with highly reinforced M400 concrete.

TABLE 8

Binder Properties vs Alloying Additive Specific Surface Area*

| Carbon Nanotube Specific Surface Area, m$^2$/g | Propertes** | | | | | |
|---|---|---|---|---|---|---|
| | Porosity, % | Rockwell Hardness | Bending Strength $\sigma^{изг}$, MPa | Specific Wear, mm/m$^2$ | Specific cutting wheel life, m$^2$/mm | Cutting Speed, cm$^2$/min |
| 100% $Cu_{binder}$* | 1 | 92 | 690 | 2.80 | 0.36 | 220 |
| 70 | 1.1 | 90 | 690 | 2.90 | 0.34 | 210 |
| 75 | 1.1 | 94 | 720 | 2.55 | 0.39 | 300 |
| 100 | 1.2 | 100 | 760 | 2.15 | 0.47 | 325 |
| 125 | 1.4 | 103 | 780 | 1.90 | 0.53 | 340 |
| 150 | 1.6 | 95 | 730 | 2.45 | 0.41 | 315 |
| 160 | 2.3 | 90 | 660 | 3.4 | 0.29 | 200 |

*$Cu_{binder}$ composition: 30% Cu; 35% Fe; 15% Co; 10.5% Sn; 9.5% WC

**specific wear, specific life and cutting speed are given for cutting wheel tests with highly reinforced M400 concrete.

The binder materials according to this invention will provide for better economic results compared to counterparts available from the world's leading manufacturers with respect to the price/life and price/output criteria. For example, the diamond segments for cutting highly reinforced concrete are used in an ultrahard abrasive environment. Conventional matrix hardening by tungsten carbide alloying has a concentration limit due to an increase in the required sintering temperature (this reduces the strength of the diamonds and causes extra wear of the process tooling).

Using copper as the binder base reduces the raw material costs and allows making the product 15-20% cheaper while retaining its operation merits (tool cutting speed and life) by adding WC, W, Mo and other nanoparticles.

Alloying of the materials of the first and second embodiments of the invention provides for high strength, heat conductivity and impact toughness. Controlled low alloying provides for a unique combination of favorable properties e.g. strength, hardness, impact toughness, wear resistance and cutting area friction ratio thus increasing the cutting speed by 30-60% and delivering a tool life under severe loading conditions, e.g. for cutting highly reinforced concrete, by 15-50% longer compared to the conventional material.

What is claimed is:

1. A copper based binder for the fabrication of diamond tools comprising 6-25 $m^2/g$ specific surface area nanopowder alloying addition with the following component ratios, wt. %:

Cu=30-60;

Fe=20-35;

Co=10-15;

Sn=5-10.5;

WC=9.5-20; and alloying addition=1-15.

2. The binder of claim 1, wherein said alloying addition is selected from the group consisting of tungsten carbide, tungsten, molybdenum, aluminum oxide, zirconium dioxide, niobium carbide, silicon nitride, and mixtures thereof.

3. A copper based binder for the fabrication of diamond tools comprising 75-150 $m^2/g$ specific surface area nanopowder alloying addition with the following component ratios, wt. %:

Cu=30-60;

Fe=20-35;

Co=10-15;

Sn=0-10.5;

WC=0-20; and alloying addition=0.01-5.

4. The binder of claim 3, wherein said alloying addition is in the form of carbon nanotubes or nanosize grained diamond.

* * * * *